United States Patent [19]

Edwin R. Carney

[11] Patent Number: 5,042,743

[45] Date of Patent: Aug. 27, 1991

[54] APPARATUS AND METHOD FOR MULTIPLE TARGET ENGAGEMENT

[75] Inventor: Edwin R. Carney, St. Louis, Mo.

[73] Assignee: Electronics and Space Corporation, St. Louis, Mo.

[21] Appl. No.: 482,152

[22] Filed: Feb. 20, 1990

[51] Int. Cl.[5] ..... F41G 7/30; F41G 7/32

[52] U.S. Cl. ..... 244/3.11

[58] Field of Search ..... 244/3.11, 3.12, 3.14

[56] References Cited

U.S. PATENT DOCUMENTS

| | | | |
|---|---|---|---|
| 3,753,538 | 8/1973 | Marsh et al. | 244/3.12 |
| 4,274,609 | 6/1981 | Ferrier et al. | 244/3.14 |
| 4,860,968 | 8/1989 | Pinson | 244/3.12 |

*Primary Examiner*—Charles T. Jordan

*Attorney, Agent, or Firm*—Polster, Polster and Lucchesi

[57] ABSTRACT

Apparatus (10) for simultaneously engaging a multiplicity of selected targets (V1–V7) to launch one or more missiles (T) at each target and acquire, track, and guide each missile to its respective target. A field of view (FOV) is scanned to detect one or more targets therewithin. A target selection system (34) is used to designate various of the targets at which to launch missiles. A plurality of missiles are then launched, and directed to each selected target. A plurality of sensors (58) detect radiation from each missile as it travels toward its respective target. An acquisition and tracking system (74) is used to track each missile and its target. The system includes a processor (80) for determining the position of each missile relative to its respective target, and a control module (82) responsive to the processor for generating and transmitting guidance signals to each missile to guide it to its target.

12 Claims, 5 Drawing Shee

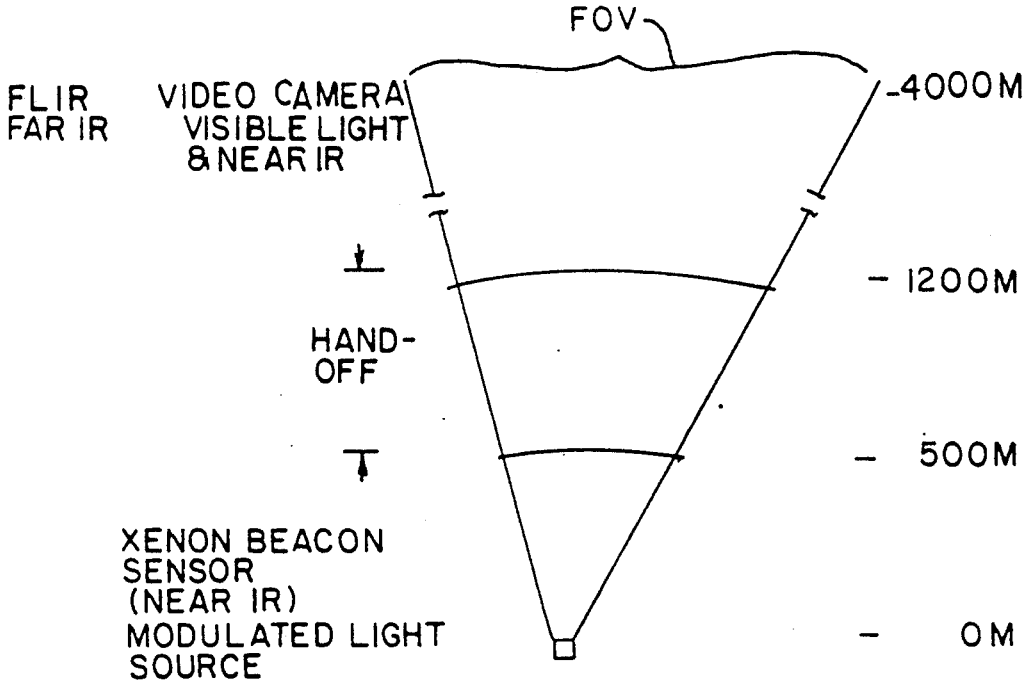
FIG. 2B.
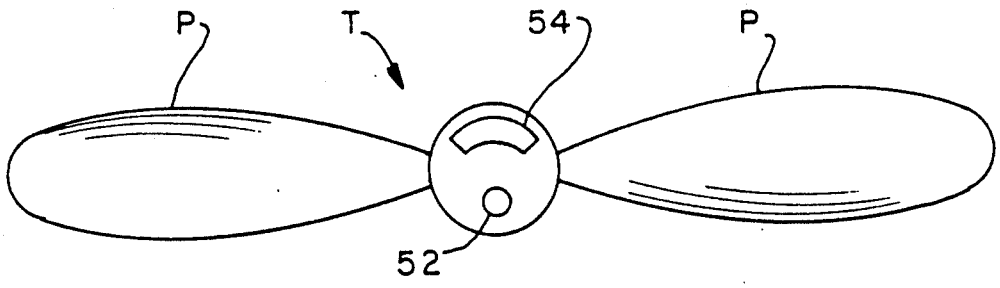
FIG. 2A.
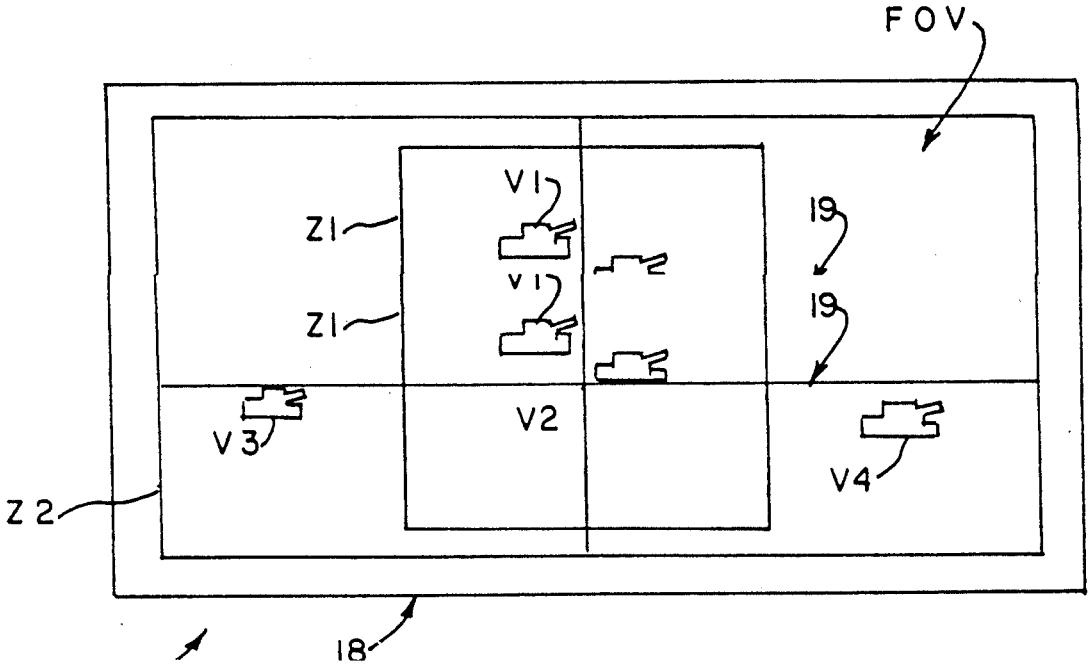

APPARATUS AND METHOD FOR MULTIPLE TARGET ENGAGEMENT

BACKGROUND OF THE INVENTION

This invention relates to tube-launched, optically-sighted, wire-guided (TOW) missiles and in particular, to a method and apparatus for launching a number of missiles at separate targets and then simultaneously guiding the missiles to each target.

TOW missiles have been in development for some time and have been adapted for a variety of uses. The missiles can be ground launched by a soldier in a land based vehicle or launched from an airborne vehicle such as a helicopter. Regardless of whether ground or air launched, a gunner looking through a sight first identifies a target such as a tank in his field of view and then launches a single missile at this single target. During target sighting and missile tracking, the gunner keeps the target lined up in the cross-hairs of his sight. The position of the missile relative to the target is continuously monitored and correction signals are sent to it, through guide wires, to direct it to the target.

Tracking and guidance systems for TOW missiles have been developed so the missile can be guided to the target through a battlefield obscured by smoke or fog, or at night. Further, these systems have the capability to identify countermeasures taken by the enemy to prevent the missile from hitting the target. Once the countermeasures have been identified, the systems can avoid them and thus not be misled into steering a missile away from its target.

Heretofore, TOW missile systems have not had the capability to engage more than one target at a time. In the close combat situation which occurs on a battlefield, the gunner must continuously expose himself to risk as he sequentially engages a series of targets.

Studies have shown that a multiple target engagement (MTE) capability in TOW missile systems would yield significant advantages. In one study, for example, it has been demonstrated that the loss-exchange ratio (LER) improves dramatically in favor of one who has a MTE capability. (The LER is a measure of how much damage is inflicted by one side in an exchange in proportion to how much damage is inflicted by the other side during the exchange.)

Implementation of an MTE capability gives rise to a number of problems. A first of these is multiple missile tracking capability. In present TOW systems, for example, there is launch phase tracking and post-launch phase tracking. During the missile's launch phase, a beacon operating in one region of the light spectrum is used for tracking. When the missile's fuel is exhausted and its flight engine shuts down, a second beacon is activated which emits light in a different region, and the missile is now tracked by either the first or second beacon depending upon how obscure the battlefield is and the countermeasures taken by the other side. In an MTE system, more than one missile may be launched, with the missiles being launched in rapid succession. This now requires a tracking system to simultaneously track missiles from radiation in various regions of the spectrum and not lose track of any of the missiles.

A second problem involves target location by the gunner. As discussed above, the gunner, in previous TOW systems, positioned a cross-hairs in his sight on a target to be hit. He then kept the cross-hairs trained on the target to help guide the missile to the target. With multiple targets, it is not possible to do this. Consequently, the gunner needs a way to easily identify and "tag" individual targets which may be anywhere in his field of view. The system now has to keep track of each separately moving target, as well as keep track of which missile is directed at which target.

A third problem involves control of the sight to keep the targets within the gunner's field of view. A battlefield situation is dynamic. A target is not necessarily going to remain in one place during the time it takes for it to be identified as a target and for a missile to be launched at and to hit it. In a single target situation, this poses no problem because, again as discussed, the gunner keeps the cross-hairs in his sight trained on the target. In multiple target systems, the situation is quite different. With two or more independent targets moving about the battlefield, the line-of-sight must be controlled so to keep all the targets being tracked within the field of view.

SUMMARY OF THE OBJECTS

Among the several objects of the present invention may be noted the provision of a method and apparatus for simultaneously engaging a multiple number of independent targets to launch and guide missiles to each target to destroy them; the provision of such method and apparatus for use with a TOW missile system in which the missile may be ground launched or launched from an airborne vehicle such as a helicopter; the provision of such method and apparatus which allows a gunner to interact with a targeting, tracking and guidance system to quickly and easily select targets for destruction, designate which targets have been selected, and thereafter guide missiles to the designated targets; the provision of such method and apparatus for sequentially launching missiles at designated targets and thereafter simultaneously tracking all the missiles by radiation occurring in either the short-wave length or long-wave length region of the light spectrum and radiated from each missile throughout the launch phase of all the missiles including the last missile to be launched; the provision of such method and apparatus having the capability to track each missile by radiation from the missiles in more than one region of the spectrum; the provision of such method and apparatus for continuously maintaining all designated targets within the gunner's field of view despite movement of the targets toward or away from each other; the provision of such method and apparatus by which the gunner can selectively adjust the impact point for each missile at any time throughout its flight for the missile to hit the target at a particular point determined by the gunner; and, the provision of such method and apparatus which allows the user to inflict a maximum amount of damage on an enemy while exposing himself to a minimum amount of risk.

In accordance with this invention, generally stated, apparatus is provided for simultaneously engaging a multiplicity of selected targets to launch a separate missile at each target and acquire, track, and guide each missile to its respective target. The apparatus includes an optical or electro-optical sight for scanning a field of view to detect one or more targets therewithin and a target selector for designating or "tagging" various of the targets at which missiles will be launched. A launch platform is provided for launching a plurality of missiles at least one of which is directed at each selected target.

An acquisition and tracking system is used for locating each missile in the field of view as it travels toward its respective target. The system utilizes sensors for simultaneously detecting radiation from each missile. The system also includes circuitry for tracking each individual target and circuitry responsive to inputs from the sensors for determining the location of each missile relative to its respective target. A guidance and control system is responsive to the position of each missile relative to its target for generating and transmitting a signal to the missile to guide it to its target.

As a method, the invention comprises scanning a field of view to detect one or more targets therewithin, selecting various of the targets at which to launch missiles, and launching a plurality of missiles one or more of which is directed at each selected target. The method further includes acquiring and tracking each missile as it travels toward its respective target, this step involving simultaneously detecting radiation from each missile, determining the position of each missile relative to its respective target based upon such detected radiation, and responding to the position of each missile relative to its target by generating and transmitting a signal to the missile to guide it to its target.

Other objects and features will be in part apparent and in part pointed out hereinafter.

BRIEF DESCRIPTION OF THE DRAWINGS

FIG. 2A is a rear elevational view of a TOW type missile illustrating various light sources carried thereon or associated therewith;

FIG. 2B illustrates a field of view through which a missile travels after launch with the particular light sources used to track the missile at different points downrange from its launch site indicated;

FIG. 3 represents a modifiable field of view as seen by a gunner;

Corresponding characters represent corresponding parts throughout the several views of the drawings.

DESCRIPTION OF A PREFERRED EMBODIMENT

Figure 1:
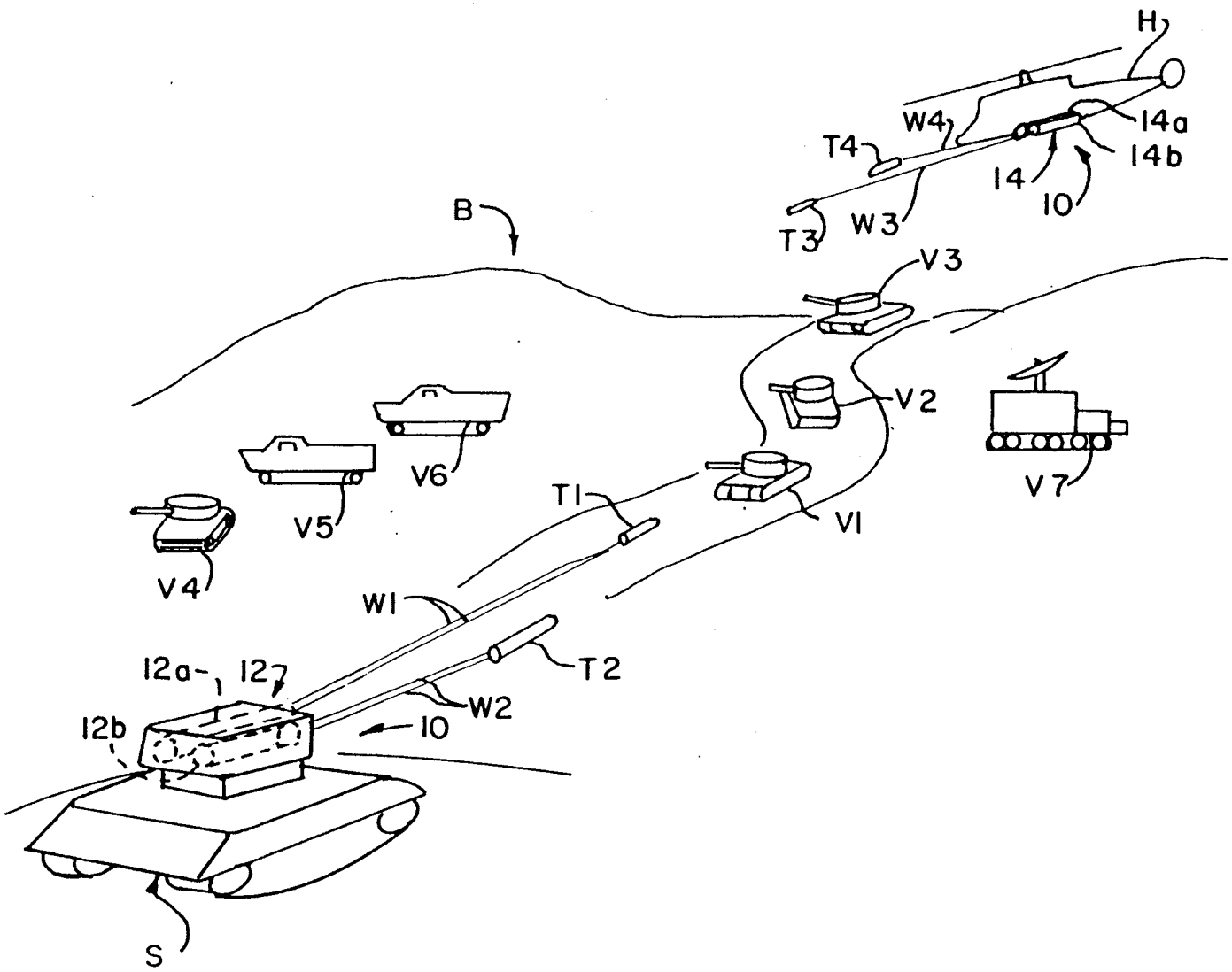
FIG. 1 is a representation of a battlefield on which is arrayed a multiplicity of targets at which missiles may be launched.

Referring to FIG. 1, a battlefield B is depicted on which are arrayed a variety of objects comprising potential targets V1–V7. The objects comprise for example tanks (V1–V4), other tracked vehicles (V5, V6), and a communications truck (V7) any of which may pose a threat. As in any battlefield situation, the objects are scattered about and may move, over time, from one location to another. It will be understood that other objects (not shown) may also present a threat. Also shown in FIG. 1 are a vehicle S and a helicopter H which are part of a force whose purpose is to destroy the various threats. As is well known in the art, a number of systems have been developed utilizing a TOW missile T to attack and destroy targets such as those shown in FIG. 1. Systems have been developed for use both by ground troops as represented by vehicle S and by air borne vehicles such as represented by helicopter H. Heretofore, these systems have allowed a single TOW missile to be launched at any one time at a selected target. To attack a multiplicity of targets such as the targets V1–V7 has meant the vehicle and/or helicopter have had to repeatedly expose themselves to enemy counter attack while they made successive attacks on one target at a time. This, accordingly, increased their risk of injury or destruction.

Apparatus 10 of the present invention, as described hereinafter, allows both the soldier and helicopter to launch a number of missiles (for example, missiles TI and T2 by vehicle S and missiles T3 and T4 by helicopter H) at any one time and then acquire, track, and guide each missile to its respective target. As seen in FIG. 1, apparatus 10 includes a vehicle mounted missile launcher 12, or an airborne launcher 14 mounted on helicopter H. Each missile is capable of launching two or more missiles, the two launch tubes **12*a*, 12*b*, and 14*a*, 14*b* for the respective launchers being exemplary only. It will be understood that the helicopter may carry a second multiple missile launcher (not shown) on the other side of its fuselage. Each missile includes a spool (not shown) of wire which is attached to each launcher, i.e., the wires W1–W4 trailing from the respective missiles T1–T4**. These are used to transmit command signals to the missiles to guide them to their respective targets.

In the description that follows, the components comprising the apparatus can be accommodated into a mobile ground launch system which is transportable about the battlefield in vehicle S, or mounted on and in helicopter H. The functioning of the components is the same regardless of whether part of a ground launch or air launch system.

Figure 5:
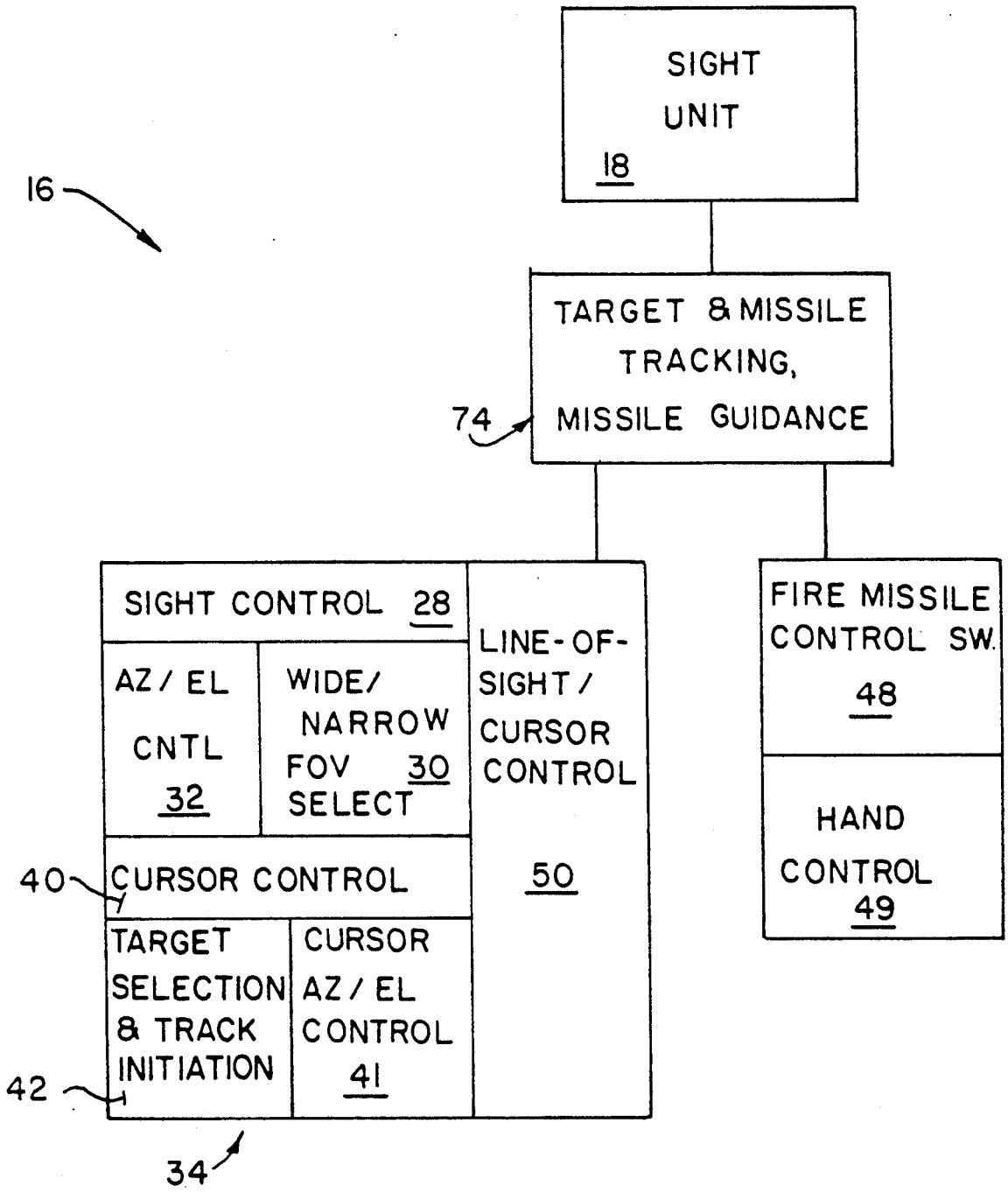
FIG. 5 is a block diagram for control of the sight display to modify a field of view and designate targets.
Figure 6:
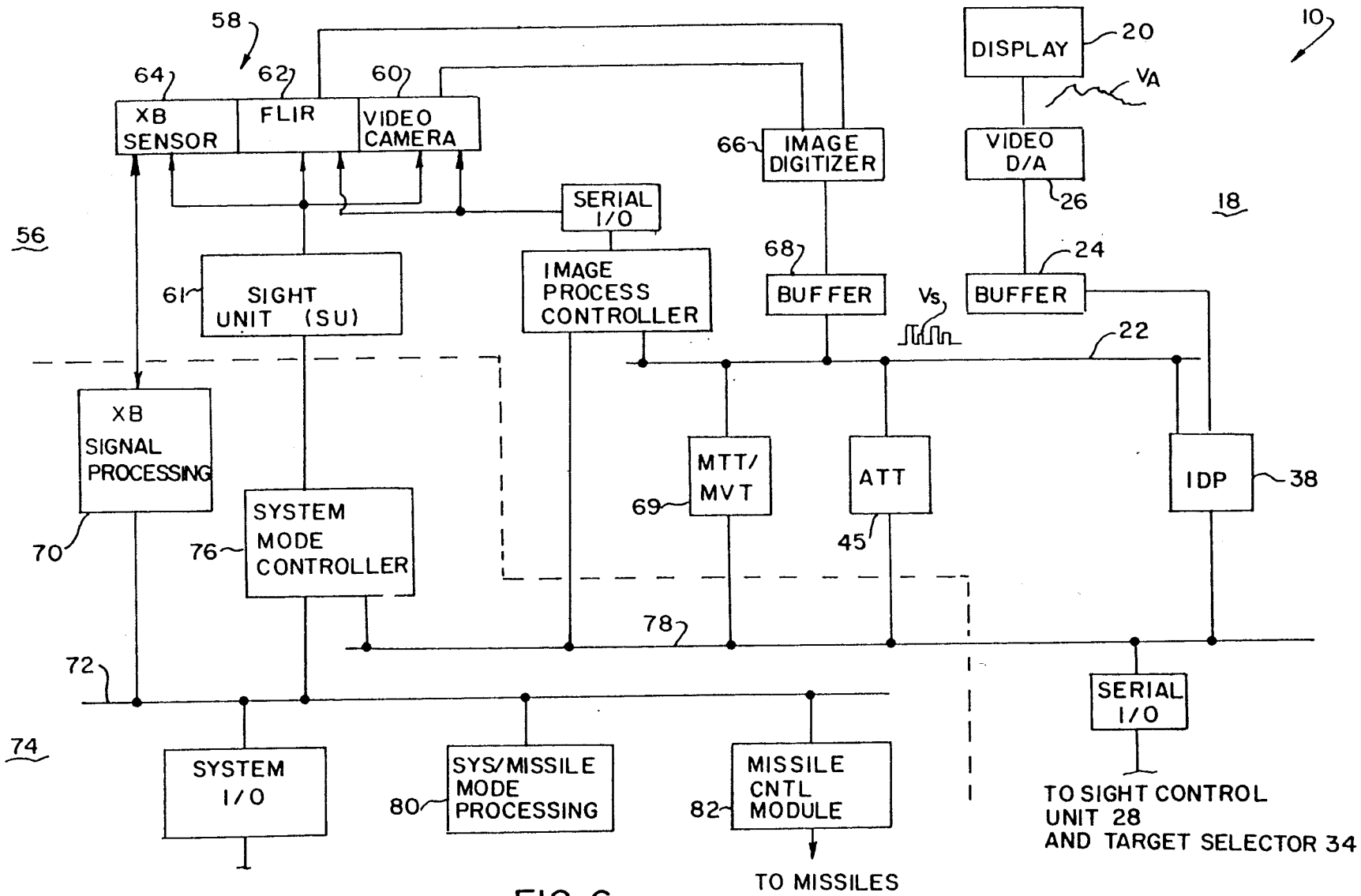
FIG. 6 is a block diagram of the apparatus.

The apparatus first includes means 16 for scanning a field of view (FOV) to detect one or more targets on the battlefield As shown in FIGS. 3–5, means 16 comprises an optical, or electro-optical, sight 18 by which a soldier in the vehicle, or gunner in the helicopter, views the battlefield. The sight includes a reticle or cross-hairs 19. The sight has a suitable display 20 (see FIG. 6). The display may be a cathode ray tube (CRT) display, a light-emitting diode (LED) display, or an electroluminescent (EL) flat panel, plasma display. A video image signal $V_S$ is supplied to the display from an image bus 22. The video signal on this bus is developed from a variety of sensors (to be described hereinafter) which respond to radiation from the missile, target, and background scene which occurs in various regions of the light spectrum. The video signal on the bus is a digital signal. For display purposes in the sight, this signal is taken from the bus, transmitted through a buffer 24, and then routed through a digital-to-analog (D/A) converter 26. The resultant analog signal $V_A$ is then supplied to the display.

Means 16 also includes a sight control unit 28 (see FIG. 5) for changing the size of the field of view and its location. As shown in FIG. 3, the field of view can be increased from a first size Z1 in which only two potential targets, V1 and V2, are observable, to a second and larger size Z2 in which two additional potential targets, V3 and V4, are observable. It will be understood that for purposes of engaging targets, the field of view must be limited to only one of its sizes, for example, its first and smaller size Z1. Sight control unit 28 has various controls including a field of view size selection control 30 and an azimuth (AZ) and elevation (EL) position control 32. The size selection control provides commands to the sight to make the field of view larger or smaller. The position control allows the user to shift the field of view up and down, and to the right or left.

Means 16 next includes a target selector or designation means 34 for selecting various of the targets at which to launch missiles. In conventional single missile systems, the user selects a target by aligning a cross-hairs in his sight on the chosen target and keeping it there throughout the launch and tracking phases of the attack. For a multi-target engagement system such as apparatus 10, when a number of targets are simultaneously attacked, this is not possible. Rather, optical sight 18 includes a cursor 36, which is in the form of an open cross-hair as depicted in FIGS. 4A–4E, and which is generated by an interactive display processor (IDP) 38. This unit responds to user operations to move the cursor about the field, and "tag" designated targets. The cursor is movable about the display in response to commands from a cursor control unit 40.

Figure 4A:
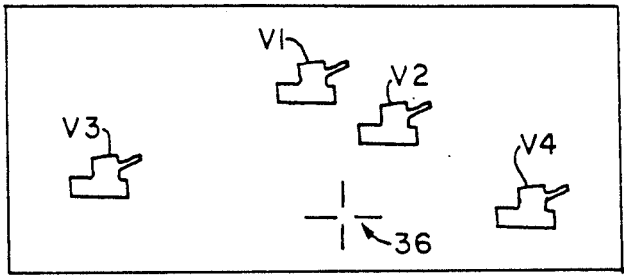
FIGS. 4A–4E depict the use of a cursor display on the gunner's sight to "tag" or designate a plurality of targets within the field of view.
Figure 4B:
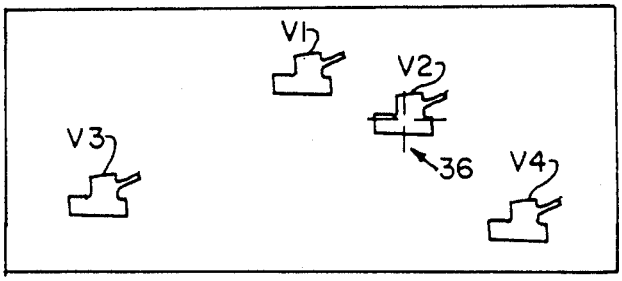
Figure 4C:
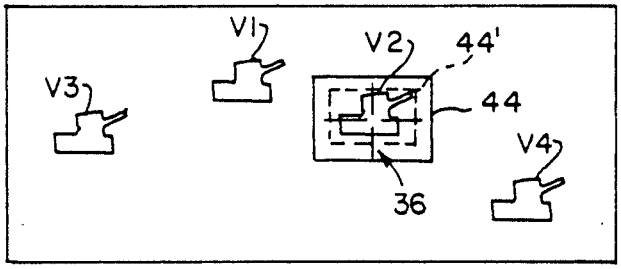

Referring to FIGS. 4A–4E, cursor 36 has an initial position shown in FIG. 4A. When the user has detected targets present in a field of view and determined which he wishes to attack, he uses a cursor azimuth and elevation control 41 to move cursor 36 up and to the right, for example, as shown in FIG. 4B. When the cursor has been positioned over the image of the target displayed in the sight, he pushes a target selection switch 42 to designate or "tag" the target. The IDP now generates a track box 44 which appears on the display and which encloses the target selected. This is shown in FIG. 4C. The entire image of the target is enclosed. The size of the track box is variable and is established by the user. Switch 42 allows the user to adjust the size of track box 44 to make it larger or smaller. For example, if the user decides the track box 44 shown in FIG. 4C is too large for the selected target V2, using switch 42 allows him to decrease its size to that of the track box 44' shown in the figure. This ability to adjust frame size is important because, as described hereinafter, apparatus 10 uses the pixels contained therein to initialize and auto target track (ATT) module 45. This unit determines an aim point for the missile to be launched at the now designated target.

Figure 4D:
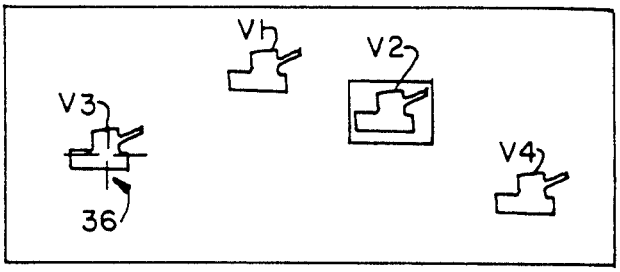
Figure 4E:
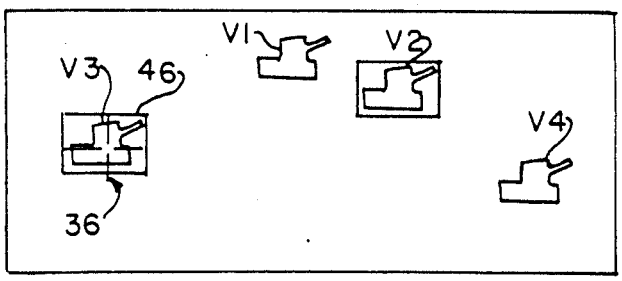

After tagging the first target, the user moves the cursor down and to the left, using cursor control switch 41, until it is touching the next selected target, for example, object V3 (see FIG. 4D). The user presses the target selection switch again and the IDP generates a new track box 46 (see FIG. 4D) which encloses this second designated target.

If the user wished to designate or "tag" other targets within his field of view, he may do so using the procedure described above. As the user tags each target, the track box co-ordinates in the field of view are supplied to the automatic target tracker (ATT) module 45. This module has the capability of thereafter tracking each of the targets and providing information as to their current location for purposes of missile guidance. It will be understood that designation of targets can be accomplished in ways other than described above. For example, the user may only need to touch the screen where a target is displayed for the IDP to generate a track box around the target and have the co-ordinates supplied to the ATT. It will further be understood that the adjustment of the track box size may be automatically made by the ATT.

When the operator has designated the targets he wishes to attack, he activates a fire missile control switch 48 which may, for example be incorporated in a gunner's hand control 49. This generates a launch missile signal to fire the missiles.

Sight control unit 28 and cursor control unit 40, may be incorporated on a control panel (not shown) or on a joystick. The switch arrangement is such that the user may easily and quickly manipulate the various switches. In either event, all the switch outputs are directed through a sight/cursor control switch 50 which is also on the panel or joystick. This switch controls the activity of the operator in using the sight control or cursor controls.

Once the user sends a "fire" or missile launch command, a series of TOW missiles are launched, at least one for each designated target. The missiles are launched in rapid succession, the interval between launches being, for example, 0.5 sec.–1.5 sec. Referring to FIG. 2A, each missile T has a flight motor (not shown) which is fired at launch and runs until the missile's fuel supply is exhausted. The engine exhaust is vented through the sides of the missile, creating horizontally extending plumes P. TOW missiles also carry beacons to help track the missile as it moves down range after launch. The missile is provided with a xenon beacon 52 which radiates modulated light in the visible to near infrared portion of the spectrum. The missile may also be provided with a pyrotechnic beacon 54 which radiates light in the far infrared portion of the spectrum.

Apparatus 10 includes a means 56 for acquiring the missiles as they move downrange and tracking them as they travel toward their designated targets. Means 56, in turn, includes a sensing means 58 for simultaneously detecting radiation from each missile. This latter means first includes a video camera 60 which is responsive to light in the visible and near infrared portions of the light spectrum. Thus it is responsive to light from the xenon beacon and exhaust plumes of each missile. Next, means 58 includes a forward looking infrared receiver (FLIR) 62 which senses the infrared radiation from beacon 54. Lastly, means 58 includes a xenon beacon sensor 64 capable of simultaneously sensing the modulated radiation from the xenon beacons on the missiles and rejecting any unmodulated radiation. The signal output from this sensor acts as a modulated light source. The sensors' operations are controlled by a sight unit (SU) 61. The sight unit provides optics for the various sensors, sensor mounting and alignment, and sensor stabilization.

The video signals from camera 60 and FLIR 62 are each supplied to an image digitizer 66 which creates the video signal Vs. This signal is imparted to bus 22 through a buffer 68, and also to a combined missile thermal track and missile visual tracker (MTT/MVT) module 69. The signal from xenon beacon sensor 64 is supplied to a sensor signal processing module 70. Module 70 includes circuitry for detecting the missile locations from the sensor output signal. The processed signal is then provided to a control/data bus 72.

In single target engagement systems, tracking of the missile is accomplished by first sensing radiation from the missile occurring in one region of the spectrum and then sensing radiation occurring in a second region. The shifting of the sensing responsibility from one sensor to the other is referred to as "hand-off" Hand-off is an option which can occur any time after the missile's flight motor shuts down. When and if, the option is used depends upon the condition of the battlefield; i.e., the presence of smoke or fog, and whether or not countermeasures such as jammers are being employed.

In a multiple missile launching, which occurs in an MTE situation, missiles will be sequentially launched. As shown in FIG. 2B, during the portion of each missile's flight in which its motor is firing, tracking is done using the xenon beacon sensor 64 and the signal processor 70. This has the advantage of tracking on a modulated point source of light rather than trying to locate the missile within an exhaust plume P which can extend substantially across the field of view. It is a feature of the invention to track all the missiles launched during a sequence of firings until the motor of the last fired missile has been extinguished. This means all the missiles will continue to be tracked using the modulated radiation signal from their xenon beacons 52 and detecting this radiation with the xenon beacon sensors 64.

As previously discussed, in single missile systems, "hand-off" is optional and typically occurs after motor shut-off with tracking being shifted from use of a si gle missile xenon beacon tracker to use of the FLIR missile thermal tracker. If this were done with the multiple missiles launched in the MTE system of the present invention, the size and intensity of the exhaust plumes from the later fired missiles would saturate both the FLIR and video camera. This can result in loss of tracking of the earlier fired missiles However, signal processing module 70 filters out everything but the modulated xenon beacon signals from each missile and is designed to track multiple missiles and countermeasures such as jammers. It therefore is impervious to the presence of launch plumes emanating from later fired missiles so to maintain accurate tracking of all the missiles. Consequently, each missile launched after the "fire" command is given is tracked by xenon beacon sensor 64 until the flight motors of all the missiles are extinquished. All the missiles are then "handed-off" to the MTT/MVT module 69 which tracks the missiles using FLIR 62 and/or camera 60 video.

As the missiles move down range toward their target, an acquisition tracking and missile guidance means 74 continuously processes data relating to the location of both the missile and its associated target. Operation of means 74 is under the command of a system mode controller 76. This unit monitors the various target selection operations, and controls movement of target data and missile data between control/data bus 72 and a control/data bus 78. For tracking purposes, target tracking is done by the ATT 45 as previously noted. This unit continuously maintains co-ordinate information on the location of the targets in the field of view and supplies this information onto bus 78. Missile tracking information is available from either the xenon beacon sensor signal processor 70, on bus 72, and/or the MTT/MVT module 69 on bus 78.

The respective target and missile location data is directed by controller 76 to a processing module 80. This unit compares the current target information to the current missile information to determine if the current missiles paths will take them to their designated targets. If they will not, the module produces an error correction signal which is supplied over bus 72 to a missile control module 82. Module 82, which comprises a guide means for the missiles, is responsive to the signals to generate and transmit guidance control signals to the various missiles to guide them to their targets. During the motor firing phase of the missiles, launch, module 80 flies each missile on an off-axis trajectory (i.e. to the right or left of the line-of-sight). This helps keep the missiles separated in a signal tracking co-ordinate system of signal processor 70.

Figure 7A:
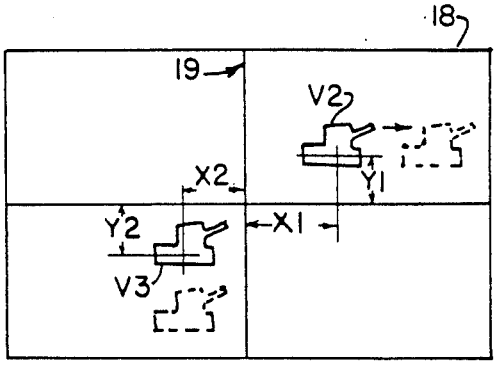
FIGS. 7A and 7B illustrate a line-of-sight control feature of the invention; and, FIGS. 8A and 8B illustrate the selection of a missile impact point on a target which differs from the missile's aim point.
Figure 7B:
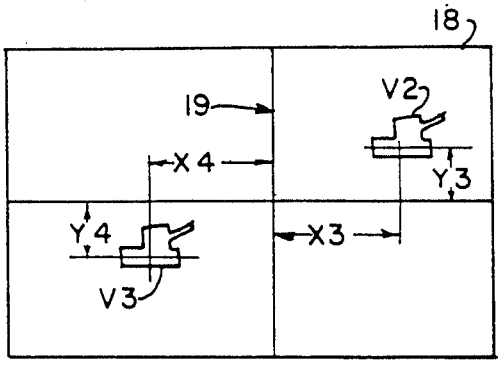

Referring to FIGS. 7A–7B, since various of the designated targets may be mobile, it is probable that between the time they are designated as targets and missiles reach them, they will move relative to each other. One function of module 80 is to adjust the line-of-sight of sight 18. The line-of-sight is the center of the field of view, as indicated by cross-hairs 19. Consider, for example, the two targets V2 and V3 previously designated. After the target designation process is completed, module 80 adjusts sight 18 so the line-of-sight is now centered between the two targets. As seen in FIG. 7A, the horizontal and vertical distances from each target to the center of the display are substantially equal. That is, $X1=X2$ and $Y1=Y2$.

Now, assume that each vehicle moves; vehicle V2 moving to the right, to the dashed line figure representing its new position, and vehicle V3 moving downward, to the dashed line figure representing its new position. When the next target location data is processed, module 80 recognizes first, that the targets have each moved, and second, that the line-of-sight is no longer centered between the targets. A line-of-sight control signal is then sent by module 80 to the SU to change the position of the field of view to that shown in FIG. 7B. There, the line-of-sight is again centered between the targets with $X3=X4$, and $Y3=Y4$.

The advantage of this feature is it relieves the gunner of the burden of constantly controlling the line-of-sight to the targets in the field of view. This allows the gunner to concentrate on the various target tracks so he can interact with the system to correct the tracking process.

Figure 8A:
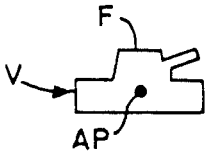

As previously discussed, when the gunner "tags" a target, the ATT determines an aim point for the missile to strike the target. This aim point is the apparent centroid of the pixel image of the target V and is displayed for the gunner. An aim point AP is shown in FIG. 8A. This aiming point may, for example, be the engine compartment of the tank shown in the figure. However, the gunner may wish to direct a missile at a different part of the target, for example, its turret F. It is a feature of the apparatus of the present invention to enable the gunner to do so.

Figure 8B:
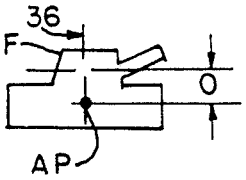

After the gunner designates a target and an aiming point AP is superimposed on the display he is viewing, he can determine whether or not the aim point is where he wants the missile to actually strike. If he wants the missile to strike a different part of the target, he moves the open reticle, or cursor 36, as previously described, to the impact point he prefers. This is shown in FIG. 8B. He again presses the target select switch. The ATT now registers the selected impact point and computes an offset "O" representing the distance between the two points. The amount of offset so determined is maintained throughout the tracking and guidance of the missile to the target so the impact point is adjusted from point AP to the selected point.

What has been described is an apparatus and method for multiple target engagement. The apparatus and method rely upon an interaction between the user and the apparatus to pick from among a number of targets those representing the greatest threat and designating those targets for destruction. Targets within his field of view are marked on his display. Co-ordinates of targets he designates for destruction are noted for subsequent target tracking. Thereafter, the apparatus maintains a line-of-sight for the user's display so that all designated targets are viewable therein. This makes it easier for the user to visually observe their movements and maintain tracking. The apparatus also allows the user to modify the impact point for each target from the aiming point determined by the apparatus when the target is selected.

The method and apparatus of the invention launch missiles at their designated target in a quick succession after a firing sequence is begun. The missiles are all tracked by radiation emitted from xenon beacons carried on each missile. Tracking using the xenon beacons continues until the flight motor of the last launched missile shuts off.

In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Apparatus for simultaneously engaging a multiplicity of selected targets to launch one or more TOW missiles at each target and acquire, track, and guide each missile to its respective target, comprising, means for scanning a field of view to detect one or more targets therewithin and for selecting various of the targets at which to launch missiles;

launch means for launching a plurality of missiles at least one of which is directed at each selected target;

sensing means for detecting radiation from each missile as the missiles travel toward their respective targets, radiation from each missile being in one of a plurality of regions within the light spectrum with a modulated radiation from each missile occurring in one of the regions during a launch phase of missile flight and unmodulated radiation occurring in the same or another region thereafter, and the sensing means including sensors for sensing radiation occurring in the various regions, one of the sensors being responsive to modulated radiation and another sensor being responsive to the unmodulated radiation; and, acquisition and tracking means responsive to the sensing means for tracking each missile, said acquisition and tracking means including means for "handing-off" the missile from the sensor for the one region to the sensor for the other regions, and processing means for determining the position of each missile relative to its respective target and guide means responsive to the processing means for generating and transmitting guidance signals to each missile to guide it to its target.

2. The apparatus of claim 1 wherein the missiles are launched sequentially and the first launched missile completes its launch phase prior to the last launched missile doing so, and the acquisition and tracking means includes means for tracking all the missiles using the sensor responsive to modulated radiation until the last of the missiles launched completes its launch phase, whereby all the missiles are tracked only using the one sensor, and for "handing-off" the missile only after all the missiles have completed their launch phase.

3. The apparatus of claim 2 wherein the sensing means includes a first sensor for sensing radiation in the visible and near infrared portion of the light spectrum, a second sensor for sensing modulated radiation in the near infrared portion of the spectrum, and a third sensor for sensing radiation in the far infrared portion of the spectrum, the acquisition and tracking means using the second sensor to track the missiles in their launch phase.

4. The apparatus of claim 3 wherein the first sensor comprises a video camera, the second sensor comprises a xenon beacon detector, and the third sensor comprises a forward looking infrared receiver (FLIR).

5. The apparatus of claim 4 further including means with which the user interacts to select targets within the field of view.

6. The apparatus of claim 2 wherein the acquisition and tracking means includes means for tracking each missile during its launch phase by offsetting the missile to one side of a line-of-sight for the field of view or the other thereby to distinguish the different tracks of the different missiles.

7. Apparatus for simultaneously engaging a multiplicity of selected targets to launch one or more TOW missiles at each target and acquire, track, and guide each missile to its respective target, comprising, means for scanning a field of view to detect one or more targets therewithin and for selecting various of the targets at which to launch missiles, the scanning means including an optical display through which a user of the apparatus observes the field of view and locates targets therein, target selection means operable by the user to designate, or "tag", each target selected, means for generating a cursor visible on the display, the target selection means including user operable means for moving the cursor about the field of view from one potential target to another, user operable switch means for the user to "tag" a selected target prior to moving the cursor to the next potential target, means for defining an area within the field of view in which the selected target is enclosed, means for processing the image enclosed within the area to determine an aim point for the missile to be launched at the target, the aim point for each missile being presented on the display, and the target selection means further including means by which the user can select a different point on the target from the aim point which the missile is to hit, and means for determining an offset between the two points which is used in guiding the missile;

launch means for launching a plurality of missiles at least one of which is directed at each selected target;

sensing means for detecting radiation from each missile as the missiles travel toward their respective targets; and, acquisition and tracking means responsive to the sensing means for tracking each missile, said acquisition and tracking means including processing means for determining the position of each missile relative to its respective target and guide means responsive to the processing means for generating and transmitting guidance signals to each missile to guide it to its target.

8. Apparatus for simultaneously engaging a multiplicity of selected targets to launch one or more TOW missiles at each target and acquire, track, and guide each missile to its respective target, comprising, means for scanning a field of view to detect one or more targets therewithin and for selecting various of the targets at which to launch missiles, the scanning means including an optical display through which a user of the apparatus observes the field of view and locates targets therein, and means for establishing a line-of-sight within the field of view and means by which the user can designate targets within the field of view at which missiles are to be launched;

launch means for launching a plurality of missiles at least one of which is directed at each selected target;

sensing means for detecting radiation from each missile as the missiles travel toward their respective targets; and, acquisition and tracking means responsive to the sensing means for tracking each missile, said acquisition and tracking means including processing means for controlling the line-of-sight whereby each selected target is maintained substantially equidistant from the line-of-sight for all selected targets to be continuously observable by the user for determining the position of each missile relative to its respective target, and guide means responsive to the processing means for generating and transmitting guidance signals to each missile to guide it to its target.

9. A method for simultaneously engaging a multiplicity of selected targets to launch one or more TOW missiles at each target and acquire, track, and guide each missile to its respective target, comprising:

scanning a field of view to detect one or more targets therewithin and selecting various of the targets at which to launch missiles;

sequentially launching a plurality of missiles at least one of which is directed at each selected target;

acquiring and tracking each missile as it travels toward its respective target, said acquiring and tracking including simultaneously detecting radiation from each missile and determining the position of each missile relative to its respective target based upon such detected radiation, and further including sensing a modulated radiation from each missile until the flight motor on the last to be launched missile shuts off; and, responding to the position of each missile relative to its target by generating and transmitting a signal to the missile to guide it to its target.

10. The method of claim 9 further including "handing-off" all the missiles by sensing unmodulated radiation from each missile after the last launched missile's flight motor shuts off.

11. A method for simultaneously engaging a multiplicity of selected targets to launch one or more TOW missiles at each target and acquire, track, and guide each missile to its respective target, comprising:

scanning a field of view to detect one or more targets therewithin and selecting various of the targets at which to launch missiles, the scanning the field of view including observing it through an optical display, and selecting a target including presenting a cursor on the display, moving the cursor about the display from one potential target to another, activating a switch when the cursor is positioned over a potential target to designate that target as one at which a missile will be launched, determining an aim point for a missile whenever a target for the missile is selected, selection by the user including selection of an impact point different from the aim point;

launching a plurality of missiles at least one of which is directed at each selected target;

acquiring and tracking each missile as it travels toward its respective target, said acquiring and tracking including simultaneously detecting radiation from each missile and determining the position of each missile relative to its respective target based upon such detected radiation, and compensating the missile's path to take into account any offset between the aim point and the user selected impact point; and, responding to the position of each missile relative to its target by generating and transmitting a signal to the missile to guide it to its target.

12. A method for simultaneously engaging a multiplicity of selected targets to launch one or more TOW missiles at each target and acquire, track, and guide each missile to its respective target, comprising:

scanning a field of view to detect one or more targets therewithin and selecting various of the targets at which to launch missiles;

establishing a line-of-sight within the field of view and thereafter automatically adjusting the line-of-sight to account for movement of the selected targets about the field of view whereby each selected target is maintained approximately equidistant from the line-of-sight so the user can observe all the selected targets at all times in the field of view;

launching a plurality of missiles at least one of which is directed at each selected target;

acquiring and tracking each missile as it travels toward its respective target, said acquiring and tracking including simultaneously detecting radiation from each missile and determining the position of each missile relative to its respective target based upon such detected radiation; and, responding to the position of each missile relative to its target by generating and transmitting a signal to the missile to guide it to its target.

* * * * *